US009470237B2

(12) United States Patent
Maruyama et al.

(10) Patent No.: US 9,470,237 B2
(45) Date of Patent: Oct. 18, 2016

(54) ELECTRIC FLUID PUMP

(71) Applicant: SHINANO KENSHI CO., LTD., Ueda-shi, Nagano (JP)

(72) Inventors: Nobuchika Maruyama, Nagano (JP); Masayuki Kodani, Nagano (JP); Takeshi Miyasaka, Nagano (JP)

(73) Assignee: SHINANO KENSHI CO., LTD., Ueda (JP)

( * ) Notice: Subject to any disclaimer, the term of this patent is extended or adjusted under 35 U.S.C. 154(b) by 213 days.

(21) Appl. No.: 14/150,300

(22) Filed: Jan. 8, 2014

(65) Prior Publication Data

US 2014/0241915 A1 Aug. 28, 2014

(30) Foreign Application Priority Data

Feb. 26, 2013 (JP) ..... 2013-036414

(51) Int. Cl.

| | |
|---|---|
| ***F04D 29/04*** | (2006.01) |
| ***F04D 25/06*** | (2006.01) |
| ***F04D 13/06*** | (2006.01) |
| ***F04D 29/043*** | (2006.01) |

(52) U.S. Cl.

CPC ..... *F04D 25/0606* (2013.01); *F04D 13/0606* (2013.01); *F04D 13/0626* (2013.01); *F04D 13/0633* (2013.01); *F04D 29/043* (2013.01)

(58) Field of Classification Search

CPC .. F04D 13/026; F04D 13/06; F04D 13/0606; F04D 13/0633; F04D 29/04; F04D 29/043; F04D 29/044; F04D 29/0646

USPC ..... 417/423.11, 423.12

See application file for complete search history.

(56) References Cited

U.S. PATENT DOCUMENTS

| | | | | |
|---|---|---|---|---|
| 2,942,555 | A * | 6/1960 | Pezzillo | F04D 13/0613 310/90 |
| 2005/0025642 | A1* | 2/2005 | Deai | F04D 29/061 417/423.12 |
| 2006/0045776 | A1* | 3/2006 | Kalavsky | F04D 13/0646 417/423.14 |
| 2006/0056992 | A1 | 3/2006 | Sadler et al. | |
| 2010/0158703 | A1 | 6/2010 | Hattori et al. | |

FOREIGN PATENT DOCUMENTS

JP A-2010-144693 7/2010

OTHER PUBLICATIONS

Jun. 1, 2016 Extended Search Report issued in European Patent Application No. 14152012.2.

* cited by examiner

*Primary Examiner* — Charles Freay
*Assistant Examiner* — Philip Stimpert
(74) *Attorney, Agent, or Firm* — Oliff PLC

(57) ABSTRACT

An electric fluid pump includes: a case including a recess portion into which a fluid flows; a rotor arranged in the recess portion; an axial member supporting the rotor; and a flange member insert-molded with the case and the axial member, secured to an end portion of the axial member, and buried in a bottom wall portion of the recess portion, wherein the flange member includes: a first flange portion; a reduced portion closer to an inner surface of the bottom wall portion than the first flange portion, and smaller than the first flange portion in a radial direction; and a second flange portion closer to the inner surface than the reduced portion, larger than the first flange portion in the radial direction, and partially exposed from the inner surface, and the inner surface is flat.

4 Claims, 8 Drawing Sheets

ELECTRIC FLUID PUMP

CROSS-REFERENCE TO RELATED APPLICATION

This application is based upon and claims the benefit of priority of the prior Japanese Patent Application No. 2013-036414, filed on Feb. 26, 2013, the entire contents of which are incorporated herein by reference.

BACKGROUND (i) Technical Field

The present invention relates to an electric fluid pump.

(ii) Related Art

Japanese Patent Application Publication No. 2010-144693 discloses a technique for positioning an axial member by pushing the axial member against a metal mold when the axial member which supports a rotor is insert-molded with a case which has a recess portion housing the rotor.

However, as illustrated in FIGS. 1 and 3 of Japanese Patent Application Publication No. 2010-144693, an inner surface 22 of the recess portion housing the rotor is depressed to increase a capacity of the recess portion. Therefore, resistance of the fluid which has flowed into the recess portion might degrade rotation efficiency of the rotor. Further, in FIG. 6 of Japanese Patent Application Publication No. 2010-144693, depending on the flowing of the resin in insert molding, the resin preferentially flows to an inner side end surface 12b, so that the axial member might sink in a bottom wall portion of the recess portion. This might not ensure positional accuracy of the axial member.

SUMMARY

According to an aspect of the present invention, there is provided an electric fluid pump including: a case including a recess portion into which a fluid flows; a rotor arranged in the recess portion; an axial member supporting the rotor; and a flange member insert-molded with the case and the axial member, secured to an end portion of the axial member, and buried in a bottom wall portion of the recess portion, wherein the flange member includes: a first flange portion; a reduced portion closer to an inner surface of the bottom wall portion than the first flange portion, and smaller than the first flange portion in a radial direction; and a second flange portion closer to the inner surface than the reduced portion, larger than the first flange portion in the radial direction, and partially exposed from the inner surface, and the inner surface is flat.

According to another aspect of the present invention, there is provided an electric fluid pump including: a case including a recess portion into which a fluid flows; a rotor arranged in the recess portion; an axial member supporting the rotor; and a flange member insert-molded with the case and the axial member, secured to an end portion of the axial member, and buried in a bottom wall portion of the recess portion, wherein the flange member includes: a flat plate portion partially exposed from an inner surface of the bottom wall portion; a groove portion formed at an outer circumferential portion of the flat plate portion; and a projection portion projecting from the groove portion so as to be distant from the inner surface, and the inner surface is flat.

According to another aspect of the present invention, there is provided an electric fluid pump including: a case including a recess portion into which a fluid flows; a rotor arranged in the recess portion; and an axial member including an end portion buried in a bottom wall portion of the recess portion, supporting the rotor, and being insert-molded with the case, wherein the end portion includes: a first flange portion; a reduced portion closer to an inner surface of the bottom wall portion than the first flange portion, and smaller than the first flange portion in a radial direction; and a second flange portion closer to the inner surface than the reduced portion, larger than the first flange portion in the radial direction, and partially exposed from the inner surface, and the inner surface is flat.

According to another aspect of the present invention, there is provided an electric fluid pump including: a case including a recess portion into which a fluid flows; a rotor arranged in the recess portion; and an axial member including an end portion buried in a bottom wall portion of the recess portion, supporting the rotor, and being insert-molded with the case, wherein the end portion includes: a flat plate portion partially exposed from an inner surface of the bottom wall portion; a groove portion formed at an outer circumferential portion of the flat plate portion; and a projection portion projecting from the groove portion to be distant away from the inner surface, and the inner surface is flat.

DETAILED DESCRIPTION

Figure 1:
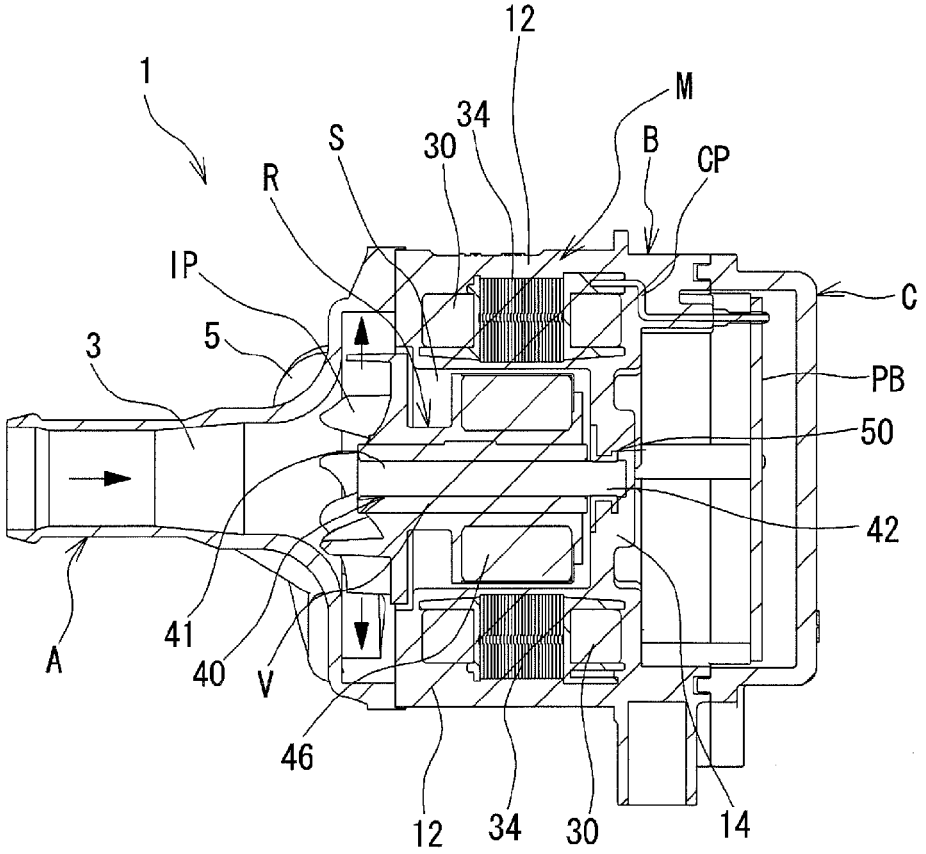
FIG. 1 is a sectional view of an electric fluid pump according to the present embodiment.

FIG. 1 is a sectional view of an electric fluid pump 1 according to the present embodiment. The electric fluid pump 1 is equipped with three cases A, B, and C. The case A is secured to the case B. The case B is secured to the case C. A motor M is arranged in the case B with parts buried therein. The motor M includes a rotor R, an iron core 30, and plural coils 34 wound around the iron core 30. A printed circuit board PB electrically connected to the coils 34 is arranged in the case C. The coils 34 and the printed circuit board PB are electrically connected via pins CP. The case A is formed with an inlet 3 for introducing the fluid and an outlet 5 for discharging the fluid. The case B is formed at its inside with a recess portion S in which the rotor R is arranged.

The case B includes a side wall portion 12 defining the recess portion S, and a bottom wall portion 14. The case B is made of a synthetic resin. The case B is insert-molded with the iron core 30, an axial member 40 supporting the rotor R for rotation, and a flange member 50 secured to an end portion 42 of the axial member 40. The iron core 30, the coils 34, and the pins CP are buried in the side wall portion 12. The end portion 42 of the axial member 40 and the flange member 50 are buried in the bottom wall portion 14. The axial member 40 is made of metal, and the flange member 50 is made of a synthetic resin. However, both may be made of metal or a synthetic resin.

The rotor R holds plural permanent magnets 46 which face the side wall portion 12 of the case B. An end side of the rotor R is provided with an impeller IP for introducing the fluid from the inlet 3 and discharging the fluid through the outlet 5.

The impeller IP is provided at an end portion 41 side of the axial member 40. A bearing V intervenes between the rotor R and the axial member 40. The bearing V is secured to the rotor R. The energization of the coils 34 excites the iron core 30 to have predetermined polarities, so that the rotor R is rotated by the magnetic force generated between the iron core 30 and the permanent magnets 46. Therefore, the impeller IP rotates.

Figure 2:
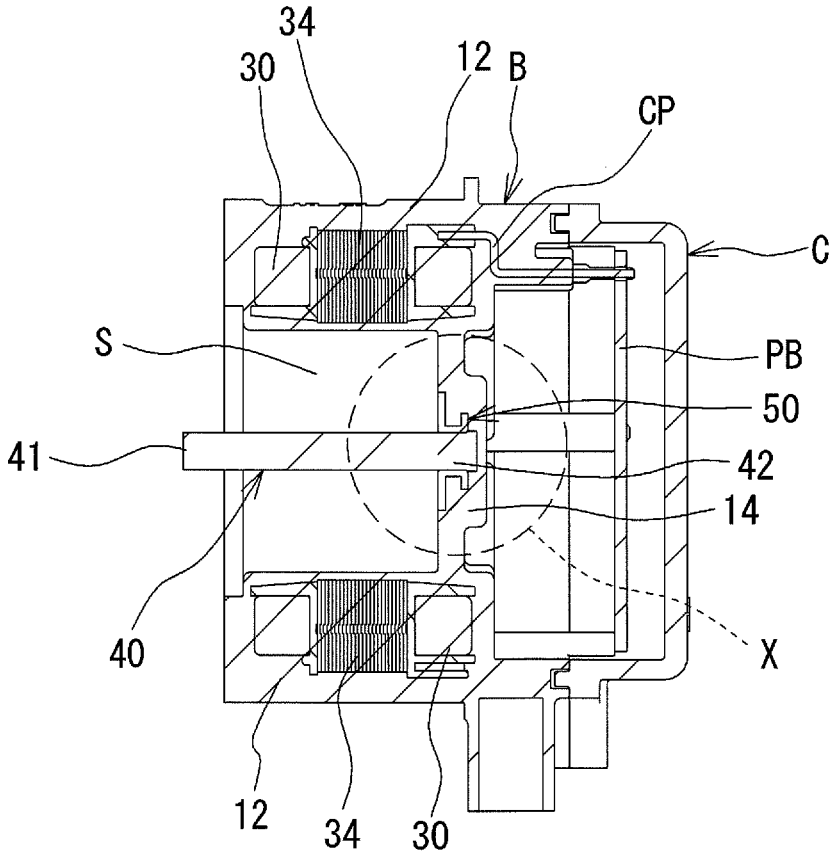
FIG. 2 is a view of the electric fluid pump from which a part of a case and a rotor are removed.

FIG. 2 is a view of the electric fluid pump 1 from which the case A and the rotor R are removed. In this way, the rotor R rotates in the recess portion S. Herein, as illustrated in FIG. 1, the fluid introduced from the inlet 3 flows into the recess portion S through a clearance between the impeller IP and an opening portion of the recess portion S. Thus, the rotor R rotates in the fluid which has flowed into the recess portion S.

Figure 3A:
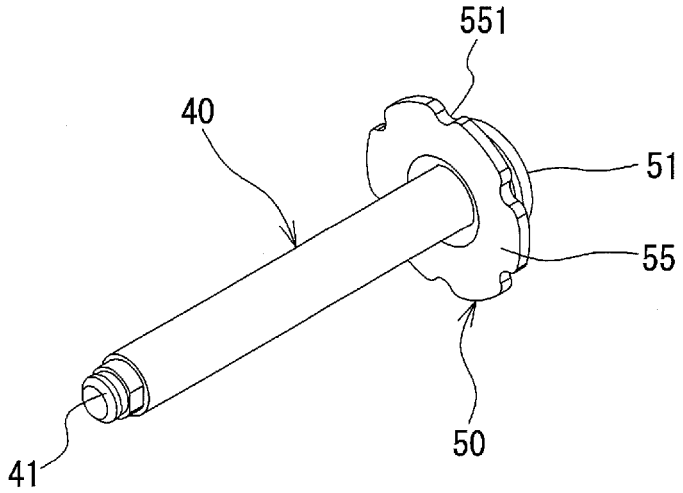
FIGS. 3A to 3C are explanatory views of the axial member and a flange member.
Figure 3B:
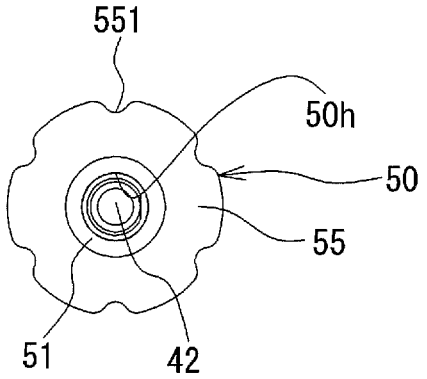
Figure 3C:
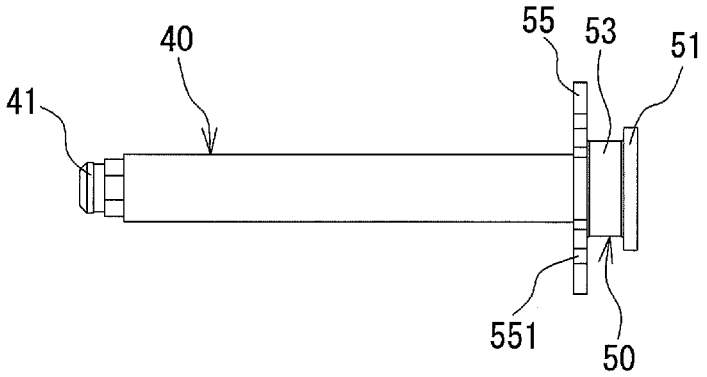

FIGS. 3A to 3C are explanatory views of the axial member 40 and the flange member 50. The flange member 50 is secured to the end portion 42.

Specifically, the end portion 42 of the axial member 40 is press-fitted into a hole 50*h* formed in the flange member 50. However, the present invention is not limited to this configuration. For example, both members may be secured by caulking. The flange member 50 includes a flange portion 51, a reduced portion 53, and a flange portion 55 in the order from the end portion 42 to the end portion 41 side. The reduced portion 53 is smaller than the flange portion 51 in the radial direction. The flange portion 55 is larger than each of the flange portion 51 and the reduced portion 53 in the radial direction.

Figure 4:
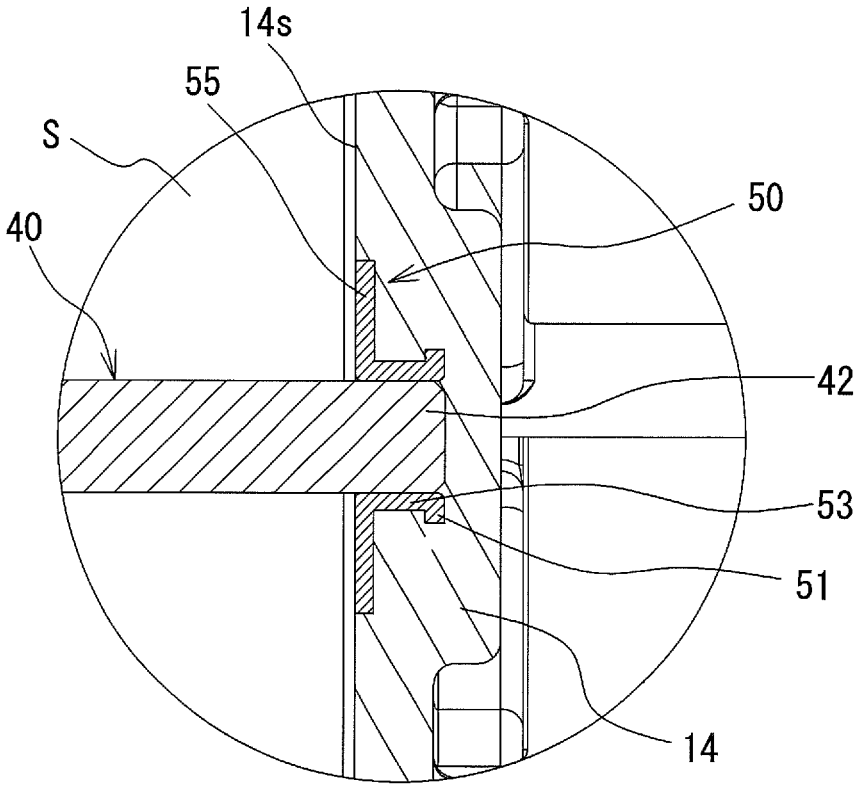
FIG. 4 is an enlarged view around the flange member surrounded by a circle X of FIG. 2.

FIG. 4 is an enlarged view around the flange member 50 surrounded by a circle X of FIG. 2. The flange portion 51 is close to an inner surface 14*s* of the bottom wall portion 14. The reduced portion 53 is closer to the inner surface 14*s* than the flange portion 51. The flange portion 55 is closer to the inner surface 14*s* than the reduced portion 53. Additionally, the flange portion 55 is partially exposed from the inner surface 14*s*, and comes into slidable contact with the end surface of the rotor R.

As illustrated in FIG. 4, the reduced portion 53 is formed between the flange portions 51 and 55, and is smaller than each of them. Therefore, even if a large tensile force is applied to the end portion 41 side of the axial member 40, the axial member 40 and the flange member 50 are prevented from being removed from the bottom wall portion 14 by the resin which is filled around the reduced portion 53 between the flange portions 51 and 55.

Also, as illustrated in FIGS. 3A to 3C, the outer circumferential portion of the flange portion 55 is provided with plural groove portions 551. The plural groove portions 551 are provided at even angular intervals around the center of the axial member 40. Thus, the flange portion 55 has a non-circular shape when viewed in the axial direction. Therefore, the flange portion 55 is prevented from being rotated in the circumferential direction by the resin filled around the groove portions 551. Additionally, the flange portion 55 may have another shape as long as it has a non-circular shape.

Figure 5:
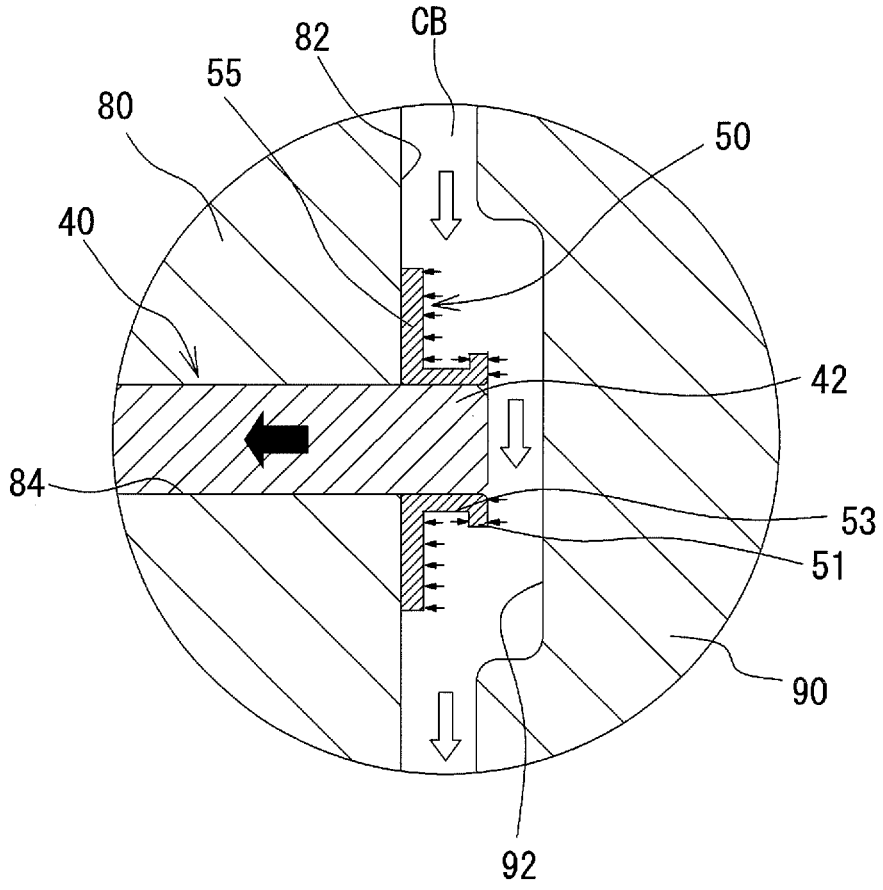
FIG. 5 is an explanatory view of insert molding of the case.

FIG. 5 is an explanatory view of the insert molding of the case B. The axial member 40 press-fitted into the flange member 50 beforehand is inserted into a hole 84 of a metal mold 80, and the flange portion 55 of the flange member 50 is brought into contact with a surface 82 of the metal mold 80. Next, the resin is filled into a cavity CB defined between the surface 82 of the metal mold 80 and a surface 92 of a metal mold 90 facing the metal mold 80.

The resin is filled into the cavity CB, so that the resin flows between the flange portions 51 and 55. The force of the resin is applied to the flange portion 55 such that the flange portion 55 is pushed against the surface 82 of the metal mold 80. The force is applied to the flange portion 51 such that the flange portion 55 moves away from the surface 82. Here, the flange portion 55 is larger than the flange portion 51 in the radial direction, and also the area of the flange portion 55 is greater than that of the flange portion 51. Therefore, the force of the resin which pushes the flange portion 55 toward the metal mold 80 is greater than that of the resin which pushes the flange portion 51 to move away from the metal mold 80.

Thus, the force of the flowing resin maintains a state where the flange portion 55 of the flange member 50 is pushed against the surface 82 of the metal mold 80. Therefore, in the state where the flange member 50 and the axial member 40 are positioned with respect to the metal mold 80, the resin is hardened to form the case B. Accordingly, the positional accuracy of the axial member 40 is ensured.

Further, since the surface 82 is flat, the inner surface 14*s* of the bottom wall portion 14 of the case B also is formed into a flat shape. This suppresses an increase in the capacity of the recess portion S after formed. This also suppresses an amount of the fluid which flows into the recess portion S, thereby suppressing the rotation efficiency of the rotor R from deteriorating.

Also, the flange member 50 is formed by pressing. Thus, the manufacturing cost of the electric fluid pump 1 is reduced.

Figure 6A:
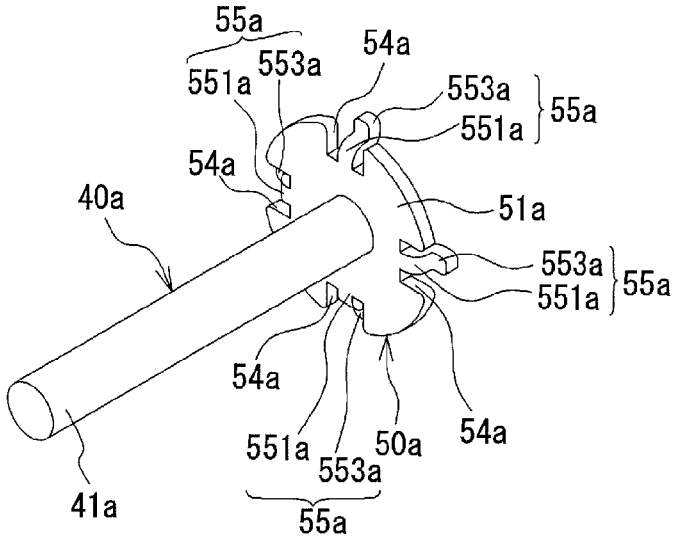
FIGS. 6A to 6C are explanatory views of an axial member and a flange member according to a variation embodiment.
Figure 6B:
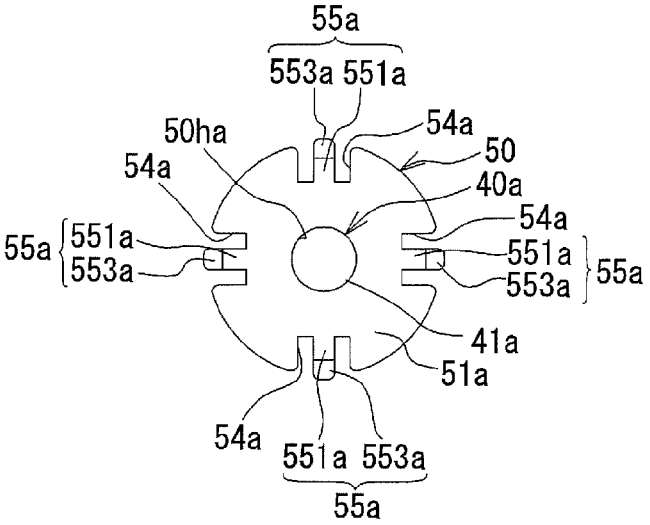
Figure 6C:
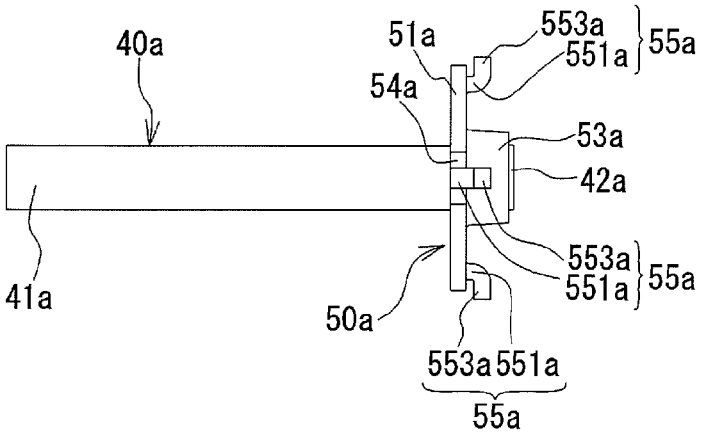

Next, a description will be given of an axial member 40*a* and a flange member 50*a* according to a variation embodiment. FIGS. 6A to 6C are explanatory views of the axial member 40*a* and the flange member 50*a* according to the variation embodiment. FIGS. 6A to 6C respectively correspond to FIGS. 3A to 3C. The flange member 50*a* is secured to an end portion 42*a*. Specifically, the end portion 42*a* of the axial member 40*a* is press-fitted into a hole 50*ha* formed in the flange member 50*a*. However, the present invention is not limited to this configuration. For example, both members may be secured by caulking. The flange member 50*a* includes a pipe portion 53*a* and a flat plate portion 51*a* in the order from the end portion 42*a* to an end portion 41*a* side. The pipe portion 53*a* is press-fitted onto the end portion 42*a*. The outer diameter of the flat plate portion 51*a* is greater than that of the pipe portion 53*a*. Also, the pipe portion 53*a* is thicker than the flat plate portion 51*a* in the axial direction.

The outer circumferential portion of the flat plate portion 51*a* is provided with plural groove portions 54*a*. The groove portion 54*a* is formed with a projection portion 55*a* which projects radially outward. The four groove portions 54*a* are provided at even angular intervals around the center of the axial member 40*a*. The projection portions 55*a* also have the same configuration. The projection portion 55*a* projects to the pipe portion 53*a* side from the flat plate portion 51*a*. Specifically, the projection portion 55*a* includes: a root portion 551*a* which projects from a bottom surface of the groove portion 54*a* and is curved; and an end portion 553*a* which projects from the root portion 551*a* in the direction perpendicular to the axial member 40*a*. The root portion 551*a* is curved to the pipe portion 53*a* side from the flat plate portion 51*a*. As illustrated in FIG. 6C, the end portion 553*a* extends more than the outer circumferential portion of the flat plate portion 51*a* in the radial outward direction.

Figure 7:
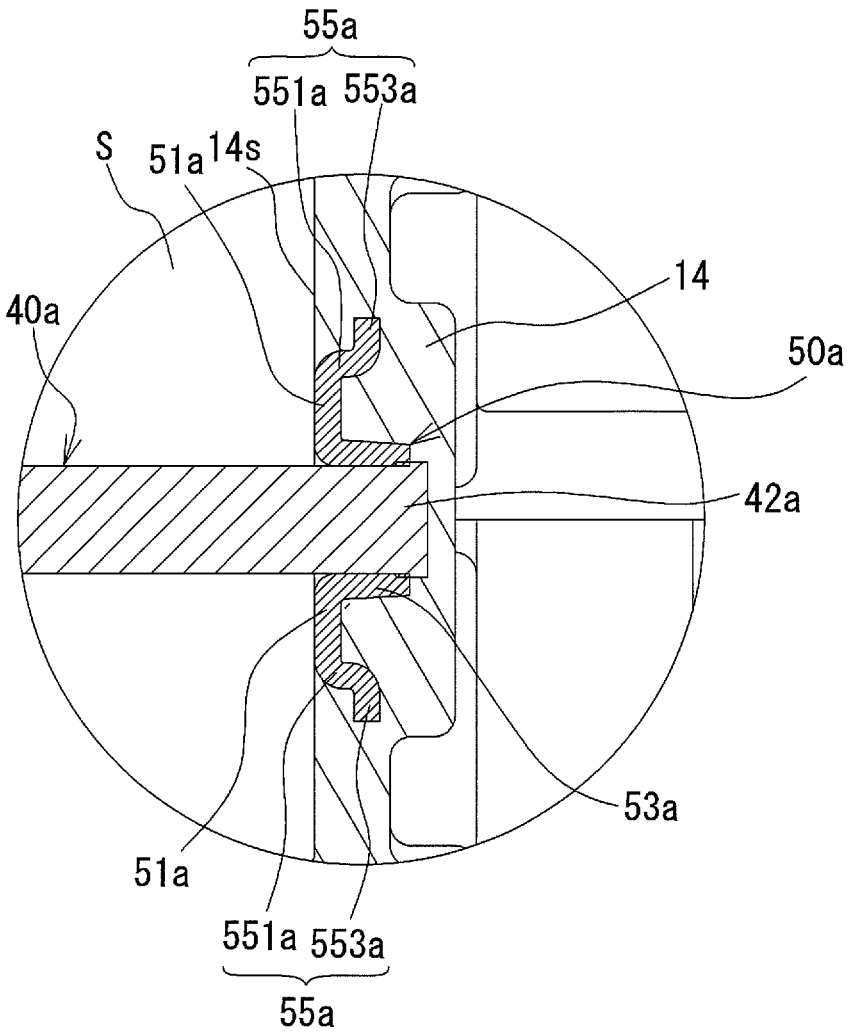
FIG. 7 is an enlarged view around the flange member according to the variation embodiment.

FIG. 7 is a partially enlarged view of an electric fluid pump equipped with the axial member 40*a* and the flange member 50*a*. FIG. 7 corresponds to FIG. 4. The end portions 553*a* are distant from the inner surface 14*s* and are buried in the bottom wall portion 14. Therefore, even if a large tensile force is applied to the end portion 41*a* side of the axial member 40*a*, the axial member 40*a* and the flange member 50*a* are prevented from being removed from the bottom wall portion 14 by the resin which is filled over the end portions 553*a*.

Also, as illustrated in FIGS. 6A to 6C, the outer circumferential portion of the flat plate portion 51*a* is provided with the plural groove portions 54*a* to have a non-circular shape. Therefore, the flat plate portion 51*a* is prevented from being rotated in the circumferential direction by the resin filled within the groove portions 54*a*.

Figure 8:
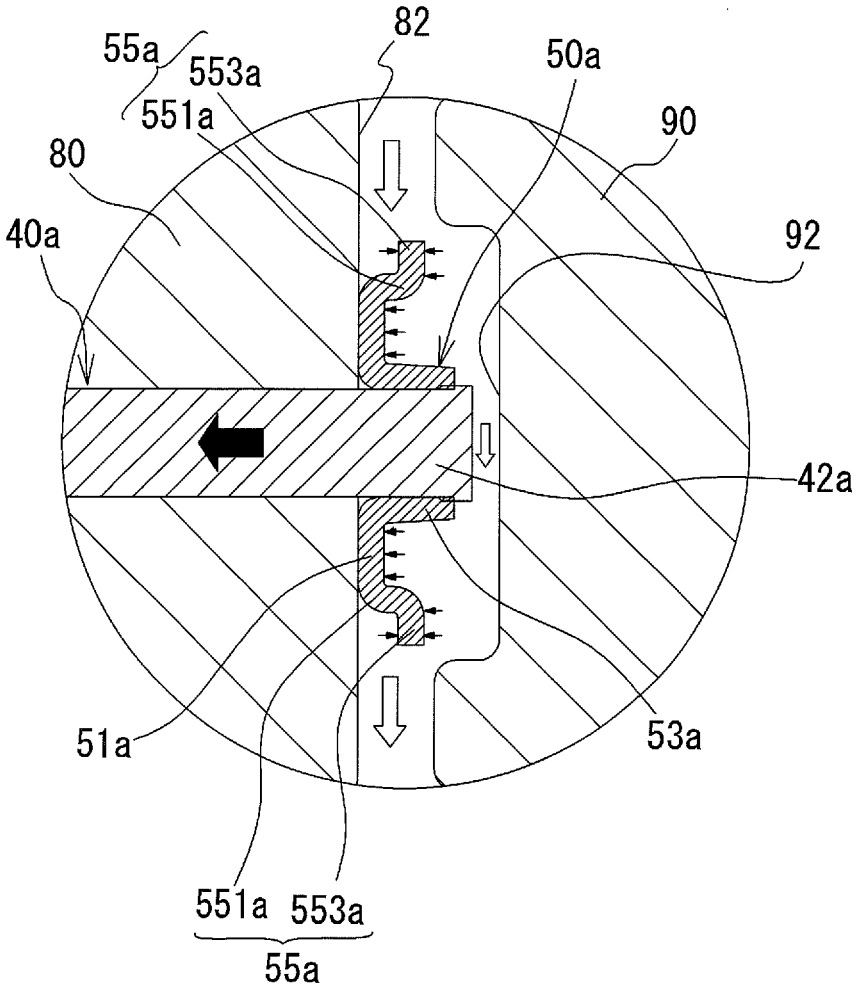
FIG. 8 is an explanatory view of insert molding of the case with the axial member and the flange member according to the variation embodiment.

FIG. 8 is an explanatory view of the insert molding of the case by use of the axial member 40*a* and the flange member 50*a*. FIG. 8 corresponds to FIG. 5. The axial member 40*a* press-fitted into the flange member 50*a* beforehand is inserted into the hole 84 of the metal mold 80, and the flat plate portion 51*a* of the flange member 50*a* is brought into contact with the surface 82 of the metal mold 80. Next, the resin is filled into the cavity CB defined between the surface 82 of the metal mold 80 and the surface 92 of the metal mold 90 facing the metal mold 80.

The resin is filled into the cavity CB, so that the resin flows around the projection portions 55*a* at first. The resin flows not only to the upper side of the end portions 553*a* but also to the lower side thereof. Also, the resin flows to the lower side of the flat plate portion 51*a*. Therefore, the force of the resin is applied to the flat plate portion 51*a* such that the flat plate portion 51*a* is pushed against the surface 82 of the metal mold 80. The force is applied to the upper surfaces of the end portions 553*a* such that the end portions 553*a* move away from the surface 82. Here, the area of the lower surface of the flat plate portion 51*a* is greater than that of the upper surfaces of the end portions 553*a*. Therefore, the force of the resin which pushes the flange member 50*a* toward the metal mold 80 is greater than that of the resin which pushes the flange member 50*a* to move away from the metal mold 80.

Thus, the force of the flowing resin maintains a state where the flat plate portion 51*a* of the flange member 50*a* is pushed against the surface 82 of the metal mold 80. Therefore, in the state where the flange member 50*a* and the axial member 40*a* are positioned with respect to the metal mold 80, the resin is hardened to form the case. Accordingly, the positional accuracy of the axial member 40*a* is ensured.

Also, the flange member 50*a* is formed by pressing. Thus, the manufacturing cost of the electric fluid pump is reduced.

While the exemplary embodiments of the present invention have been illustrated in detail, the present invention is not limited to the above-mentioned embodiments, and other embodiments, variations and modifications may be made without departing from the scope of the present invention.

The flange member may be formed by cutting. Further, an axial member which is integrally formed with an flange member may be employed.

What is claimed is:

1. An electric fluid pump comprising:

a case including a recess portion into which a fluid flows;

a rotor arranged in the recess portion;

an axial member supporting the rotor, the rotor being positioned radially outward of the axial member, the axial member being a shaft that is unrotatably fixed to the case; and a flange member insert-molded with the case and the axial member, the flange member being secured to an end portion of the axial member, the flange member being buried in a blind hole formed in a bottom wall portion of the recess portion, the flange member including:

a first flange portion;

a reduced portion disposed closer to a flat inner surface of the bottom wall portion than the first flange portion, the reduced portion being smaller than the first flange portion in a radial direction; and a second flange portion disposed closer to the flat inner surface than the reduced portion, the second flange portion being larger than the first flange portion in the radial direction, and the second flange portion being partially exposed from the flat inner surface.

2. The electric fluid pump of claim 1, wherein the flange member is made of metal and formed by pressing.

3. The electric fluid pump of claim 1, wherein the second flange portion has a non-circular shape when viewed in an axial direction of the axial member.

4. An electric fluid pump comprising:

a case including a recess portion into which a fluid flows;

a rotor arranged in the recess portion; and a shaft unrotatably fixed to the case, the shaft including an end portion buried in a blind hole formed in a bottom wall portion of the recess portion, the end portion supporting the rotor, the end portion being insert-molded with the case, the end portion including:

a first flange portion;

a reduced portion disposed closer to a flat inner surface of the bottom wall portion than the first flange portion, the reduced portion being smaller than the first flange portion in a radial direction; and a second flange portion disposed closer to the flat inner surface than the reduced portion, the second flange portion being larger than the first flange portion in the radial direction, the second flange portion being partially exposed from the flat inner surface, wherein the rotor is positioned radially outward of the shaft.

* * * * *